US007430998B2

(12) United States Patent
Stork

(10) Patent No.: US 7,430,998 B2
(45) Date of Patent: Oct. 7, 2008

(54) METHOD FOR POSITIONAL DETERMINATION OF AN EC MOTOR

(75) Inventor: Holger Stork, Buhl (DE)

(73) Assignee: LUK Lamellen und Kupplungsbau Beteiligungs KG, Buhl (DE)

( * ) Notice: Subject to any disclaimer, the term of this patent is extended or adjusted under 35 U.S.C. 154(b) by 0 days.

(21) Appl. No.: 11/575,095

(22) PCT Filed: Sep. 3, 2005

(86) PCT No.: PCT/DE2005/001545

§ 371 (c)(1),
(2), (4) Date: Apr. 24, 2008

(87) PCT Pub. No.: WO2006/029592

PCT Pub. Date: Mar. 23, 2006

(65) Prior Publication Data

US 2008/0216782 A1 Sep. 11, 2008

(30) Foreign Application Priority Data

Sep. 13, 2004 (DE) ..... 10 2004 044 620

(51) Int. Cl.
*F01L 1/34* (2006.01)

(52) U.S. Cl. ..... 123/90.17; 123/90.15; 123/90.31

(58) Field of Classification Search ..... 123/90.17, 123/90.15, 90.16, 90.31
See application file for complete search history.

(56) References Cited

U.S. PATENT DOCUMENTS 6,129,061 A * 10/2000 Okuda et al. ..... 123/90.17
2004/0083999 A1 5/2004 Miyakoshi et al.

FOREIGN PATENT DOCUMENTS

| | | |
|---|---|---|
| DE | 10315317 | 3/2004 |
| EP | 0918142 | 5/1999 |
| JP | 2004162706 | 6/2004 |

* cited by examiner

*Primary Examiner*—Zelalem Eshete
(74) *Attorney, Agent, or Firm*—Volpe and Koenig, P.C.

(57) ABSTRACT

A method for positional determination for an EC motor (14) on a device for the adjustment of the rotational angular position of the camshaft (11) of a reciprocating piston combustion engine relative to the crankshaft (12) is provided, whereby a positional measuring signal is tracked on each occurrence of a state change for a sensor signal from magnetic field sensors arranged on the stator of the EC motor (14), provided for detection of magnetic poles of the EC rotor. On error-free measurement, the signal sensor passes through a series of sensor signal states which occur at least twice per mechanical rotation of the rotor. The series of sensor signal states is determined and recorded. A fine correction of the positional measurement signal is carried out using the stored series, when the series of the measured sensor signal values differs from the stored series. Further, the rotational angle of the crankshaft (12) of the internal combustion engine is determined and, using the rotational angle and a drive parameter of an epicyclic drive for the camshaft adjuster device, a coarse adjustment of the positional measurement signal can be carried out on determining a positional measurement error which cannot be eliminated by the fine correction.

6 Claims, 3 Drawing Sheets

METHOD FOR POSITIONAL DETERMINATION OF AN EC MOTOR

BACKGROUND

The invention relates to a method for positional determination for an EC motor on a device for the adjustment of the rotational angular position of the camshaft of a reciprocating piston combustion engine relative to the crankshaft, wherein the crankshaft is in driving connection with the camshaft via an adjustment mechanism, which is constructed as a triple-shaft transmission with a crankshaft-fixed drive shaft, a camshaft-fixed driven shaft, and an adjustment shaft, which is in driving connection with the EC motor, wherein the rotor of the EC motor has magnetic segments offset relative to each other in the peripheral direction and magnetized alternately in directions opposite each other, wherein for determining the position of the rotor relative to the stator of the EC motor, a measurement device is provided, which has magnetic field sensors, which are offset relative to each other in the peripheral direction and which are arranged such that, for an error-free measurement during rotational movement of the rotor relative to the stator, they generate a digital sensor signal, which cycles through a sequence of sensor signal states, wherein this sequence occurs at least twice for each mechanical rotation of the rotor.

Such a method for determining the position of the rotor of an EC motor relative to its stator is known from practice. Here, the EC motor is a part of a camshaft adjustment device, by means of which the rotational angular position of the camshaft of a reciprocating piston combustion engine relative to the crankshaft is adjustable. The camshaft adjustment device has an adjustment mechanism, which is constructed as a triple-shaft transmission, with whose drive shaft a camshaft gear that is rotatably supported relative to the camshaft is locked in rotation, which is in driving connection with a crankshaft gear via a drive chain. A driven shaft of the adjustment mechanism is in driving connection with the camshaft and an adjustment shaft with the EC motor. For a stationary drive shaft, between the adjustment shaft and the driven shaft there is a transmission gear ratio, the so-called stationary transmission gear ratio, given by the adjustment mechanism. If the adjustment shaft rotates, then the phase position of the camshaft relative to the crankshaft increases or decreases according to the rotational direction of the adjustment shaft. In comparison with an internal combustion engine that is operated at a constant phase position, a better filling of the cylinders of the internal combustion engine can be achieved by adapting the phase position, whereby fuel is saved, the emission of pollutants is reduced, and/or the output power of the internal combustion engine can be increased.

The position of the rotor relative to the stator is measured with the help of a measurement device that has three Hall sensors, which are connected rigidly to the stator and which are distributed over the periphery of the stator. The magnetic field of the projecting magnetic segments of the rotor flows through the Hall sensors during a rotational movement between the stator and rotor. The magnetic fields of the magnetic segments induce electrical voltages, which are usable as digital sensor signals for a positional measurement, in the Hall sensors. For the positional measurement, initially a positional measurement signal is set to a start value and then the rotor is rotated relative to the stator, wherein the positional measurement signal tracked for each occurrence of a state change of the sensor signal. The positional measurement signal is fed to a control device, which energies the individual phases of the winding, such that an alternating magnetic field, which drives the rotor is formed between the stator and the rotor. The EC motor and the measurement device, however, are in practice exposed to interference radiation, which comes into the measurement device, for example, via power-supply lines, and can cause errors in the positional measurement signal. Here, it can occur on one hand that due to interference, one or more state changes are not taken into consideration during the tracking of the positional measurement signal. On the other hand, however, it is also possible that too many state changes are detected during the tracking of the positional measurement signal. In both cases, the positional measurement signal deviates from the actual position of the rotor, so that the rotor is not properly energized. Therefore, torque losses, uneven engine running, and errors in the adjustment of the rotational angular position of the camshaft relative to the crankshaft can occur.

SUMMARY

Therefore, there is the objective of creating a method of the type named above, which allows a precise adjustment of the rotational angular position of the camshaft in spite of the appearance of such interference.

This objective is met according to the features of Claim 1.

According to the invention, here the rotational angle of the crankshaft is detected and referenced for testing a positional measurement signal derived from the digital sensor signal. If a deviation which exceeds a given threshold in magnitude is determined during the testing, a coarse correction of the positional measurement signal is performed. In the coarse correction, preferably a value, which corresponds the path or a whole-number multiple of the path of one full rotation of the rotor divided by the number of magnetic field sensors, is added to or subtracted from the positional measurement signal. If the sequence of sensor signal values assigned to the positional measurement values does not match the stored sequence of sensor signal states, a fine correction of the positional measurement signal is also performed, in which the sensor signal is reproduced according to the stored sequence of sensor signal states and the positional measurement signal is corrected accordingly. Advantageously the method allows the reconstruction of the positional measurement signal both for the occurrence of small errors (e.g., less than half of the number of stored sensor signal states) and also larger errors. Claim 1 is to be understood such that in the method according to the invention, steps e) and f) can also be exchanged with steps g) and h), i.e., the fine correction can also be performed first and then the coarse correction.

In one advantageous embodiment of the invention, for the first and second crankshaft rotational angle, a crankshaft rotational angle measurement time is detected, wherein an estimated value for the rotational angle that the crankshaft exhibits at a reference time is extrapolated from the first and second crankshaft rotational angles, the time difference between the crankshaft rotational angle measurement times, and also the time interval between the crankshaft rotational angle measurement time of the second crankshaft rotational angle and the reference time, and the coarse correction and/or the fine correction is performed with this estimated value as the new second rotational angle measurement value. The correction of the second positional measurement value is here performed at a reference time lying after the crankshaft rotational angle measurement times. Here, it is possible, in particular, that the reference time can be asynchronous to a clock signal, with which the crankshaft rotational angle measurement values are detected. Nevertheless, due to the extrapolation of the new second rotational angle measurement value, a high precision of the positional measurement signal is achieved for a rotor with the same motion.

For the first and second positional measurement value, it is advantageous when a positional measurement value measurement time is detected when an estimated value for the value that the positional measurement signal exhibits at the reference time is extrapolated from the first and second positional measurement values, the time difference between the positional measurement value measurement times, and also the time interval between the positional measurement value measurement time points of the second positional measurement value and the reference time, and when the coarse correction is performed with this estimated value as a new second positional measurement value. Through these measures, even greater accuracy can be achieved for the positional determination. The reference time can be asynchronous to a clock signal, with which the positional measurement values are detected.

For a preferred embodiment of the invention, the reference time is generated at a given rotational angular position of the camshaft. This can be achieved, for example, in that the position of the camshaft is monitored with the help of a camshaft sensor and an interrupt, in which the positional measurement signal is tested and optionally reproduced, is triggered in a control device when the given camshaft rotational angular position is passed.

It is advantageous when the positional measurement values are differentiated for forming angular velocity values. The corresponding angular velocity signal can be used for determining the estimated values and/or for regulating the rotational speed of the EC motor.

In one advantageous embodiment of the invention, a correction value is determined and stored for compensating tolerances of the magnetic segments and/or magnetic field sensors for the individual magnetic segment-sensor combinations, wherein the positional measurement values and/or angular velocity values are corrected with the correction values. Therefore, in particular, positioning tolerances of the magnetic segments and/or magnetic field sensors can be compensated. The method according to the invention then allows even greater precision in the determination of the position of the rotor relative to the stator.

BRIEF DESCRIPTION OF THE DRAWINGS

Below, one embodiment of the invention is explained in more detail with reference to the drawing. Shown are.

DETAILED DESCRIPTION OF THE PREFERRED EMBODIMENTS

Figure 1:
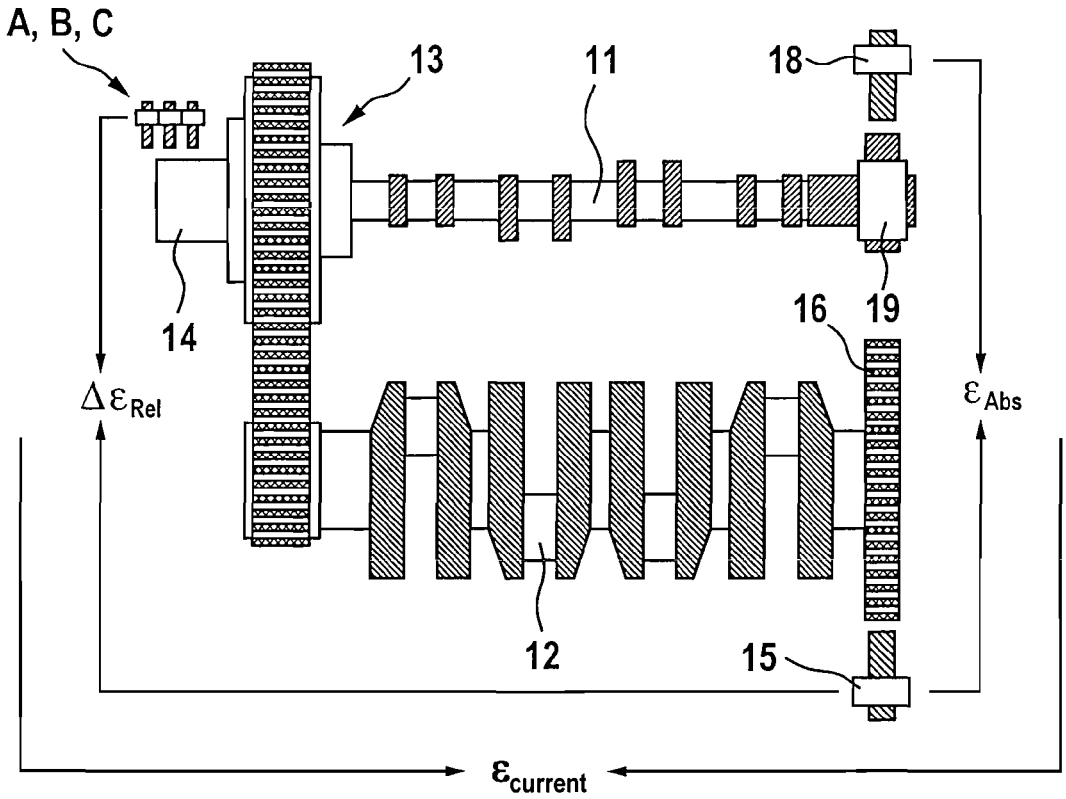
FIG. 1: a schematic representation of a crankshaft-camshaft arrangement of a reciprocating piston combustion engine, which has an adjustment mechanism for changing the rotational angular position of the camshaft relative to the crankshaft.

An adjustment device for adjusting the rotational angle or phase position of the camshaft 11 of a reciprocating piston combustion engine relative to the crankshaft 12 has an adjustment mechanism 13, which is constructed as a triple-shaft transmission with a crankshaft-fixed drive shaft, a camshaft-fixed driven shaft, and an adjustment shaft in drive connection with the rotor of an EC motor 14. In FIG. 1 it can be seen that for measuring the crankshaft rotational angle, an inductive sensor 15 is provided, which detects the tooth flanks of a toothed ring 16 arranged on the crankshaft 12 and composed of a magnetically conductive material. One of the tooth spaces or teeth of the toothed ring 16 has a greater width than the other tooth spaces or teeth and is used as a reference mark. The inductive sensor 15 is arranged on an engine block of the internal combustion engine not shown in more detail in the drawing.

When the reference mark passes the sensor 15, the measurement value for the crankshaft rotational angle is set to a start value. Then the measurement value is tracked for each detection of a tooth flank until the reference mark passes the sensor 15 again. Tracking the measurement value for the crankshaft angle is performed with the help of a control device, in whose operating program an interrupt is triggered for each detection of a tooth flank. The crankshaft rotational angle is thus measured digitally.

Figure 2:
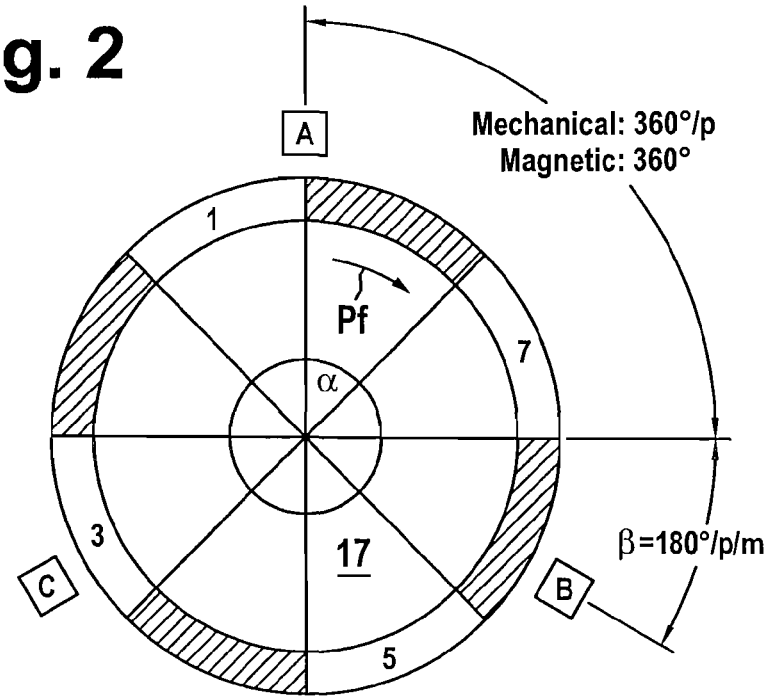
FIG. 2: a schematic side view of the rotor of an EC motor, in which the magnetic field sensors arranged on the stator are also to be seen.
Figure 3:
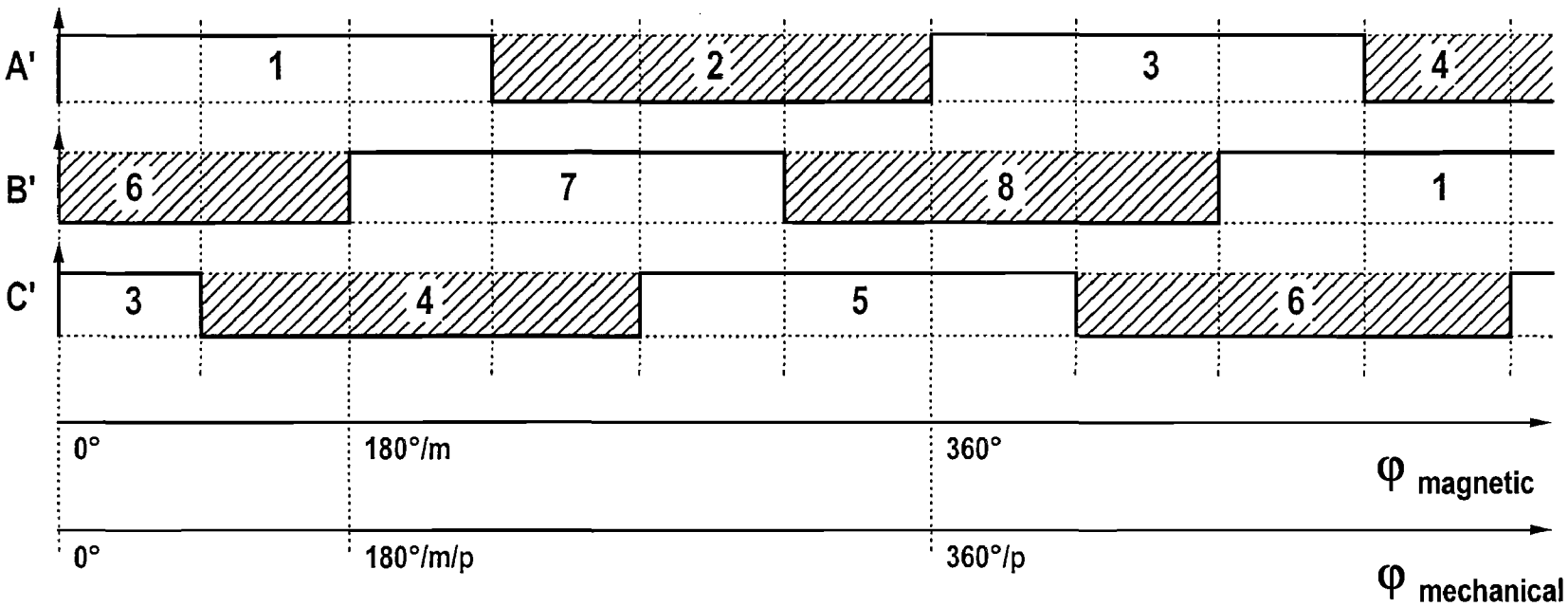
FIG. 3: a graphical representation of a sensor signal detected with the help of a positional measurement device.

As can be seen in FIG. 2, the EC motor 14 has a rotor 17, on whose periphery is arranged a series of magnetic segments 1 . . . 8, which are magnetized alternately in opposite directions and which interact magnetically via an air gap with teeth of a stator not shown in more detail in the drawing. The teeth are wrapped with a winding, which is energized via a control device.

The position of the magnetic segments 1 . . . 8 relative to the stator is detected with the help of a measurement device, which has on the stator several magnetic field sensors A, B, C, which are offset relative to each other in the peripheral direction of the stator, such that a number of magnetic segment-sensor combinations is cycled through for each rotation of the rotor. For an error-free measurement, the magnetic field sensors A, B, C generate a digital sensor signal, which, due to the arrangement of the magnetic field sensors A, B, C and the passing magnetic segments 1 . . . 8, cycles through a sequence of 2·m sensor signal states, wherein m indicates the number of magnetic field sensors A, B, C. Each sensor signal state has a position A', B', C', which can be, e.g., "0" or "1", for each magnetic field sensor A, B, C. In an error-free measurement, the individual sensor signal states appear in a predefined sequence, from which the rotational direction of the rotor 17 can be identified. This sequence is determined and stored in a non-volatile memory. For three magnetic field sensors A, B, C and a positive rotational direction, the sequence reads, e.g., 101, 100, 110, 010, 011, 001.

For a constant rotational direction, in error-free measurement each sensor signal state repeats every 2·m sensor signal values. For a rotation of the rotor, each pattern appears p times, wherein p indicates the number of pole pairs of the rotor 17. Each change of a sensor signal state triggers in the control device an interrupt, in which—starting from a start value, which can be, e.g., zero—a positional measurement signal is tracked. Here, for a positive rotational direction of the rotor, the positional measurement signal increases, e.g., by one step, and for a negative rotational direction of the rotor, it decreases by one step. If the sensor signal values match the stored sequence of sensor signal states, it is assumed that the rotor 17 has rotated by the width of one magnetic segment.

In contrast, if the newly read sensor signal value does not fit into the sequence, it is assumed either that one or more sensor signal states have been missed due to interference or that one or more sensor signal states have been received too many times. By searching the sensor signal value in the known sequence, it is determined how many sensor signal states have been missed or have been received too many times. For example, if the current sensor signal value was expected for the first time at the next pulse of a magnetic field sensor, then in the intermediate time the rotor 17 was rotated, e.g., by (2+m·n) magnetic segment-sensor combinations, without this being detected. Here, m indicates the number of magnetic field sensors of the measurement device and n indicates a whole number, which can have the value, e.g., 0, ±1, ±2, etc.

If one divides the positional measurement signal value by 2·m, then the whole number remainder R lies in the range from 0 to 2·m−1. A fixed remainder R is assigned to one sensor signal state. If the assignment between the sensor signal value and the positional measurement signal value does not match, the sensor signal value is changed by fine correction so that the assignment matches again. This can always be achieved and can be performed immediately while reading a new sensor signal value. In addition to this fine correction, the positional measurement signal value can be changed, if necessary, by coarse correction with whole multiples of 2·m, because they do not influence the remainder R.

The adjustment device has a transmitter for the rotational angular position of the camshaft 11, which has on the engine block a Hall sensor 18, which interacts with a trigger wheel 19 arranged on the camshaft 11. If the Hall sensor 18 detects a flank of the trigger wheel 19, in the operating program of the control device an interrupt is triggered, in which a crankshaft rotational angle measurement value and a sensor signal value are buffered. This interrupt is also designated as a camshaft interrupt below. At a later time, in the operating program of the control device another interrupt is then triggered, in which it is tested whether a coarse correction of the positional measurement signal is necessary and in which this correction is performed if necessary. This interrupt is also designated as a cyclical interrupt below.

To perform the coarse correction, the transmission equation of the triple-shaft transmission and the so-called stationary transmission gear ratio, i.e., the gear ratio, which the adjustment mechanism 13 exhibits for a stationary drive shaft, is used. At time $t_1$ of a first camshaft interrupt and at time $t_2$ of a second camshaft interrupt, the following applies:

$$\epsilon_1=\delta(t_1)=\phi_{Cnk,1} \tag{1}$$

$$\epsilon_2=\epsilon(t_2)=\phi_{Cnk,2} \tag{2}$$

Here, $\phi_{Cnk}$ designates the rotational angle of the crankshaft 12, $\epsilon$ designates the phase angle, the index 1 designates the time $t_1$, and the index 2 designates the time $t_2$.

At each cyclical interrupt, the following extrapolation equation further applies, in which $\phi_{Em}(t)$ designates the rotor position (rotor rotational angle) at time t, $\phi_{Em,1}$ designates the rotor position at time $t_1$, and $\phi_{Cnk}(t)$ designates the rotational angle of the crankshaft 12 at time t:

$$\varepsilon(t) = \varphi_{Cnk,1} + \frac{1}{i_g}\cdot([\varphi_{Cnk}(t) - \varphi_{Cnk,1}] - 2\cdot[\varphi_{Em}(t) - \varphi_{Em,1}]) \tag{3}$$

If one rearranges equation (3) according to rotor position $\phi_{Em}$ and solves for the time $t_2$ of the next camshaft interrupt, then under consideration of equations (1) and (2) one obtains $$\varphi_{Em,21} = \varphi_{Em,1} - \frac{i_g - 1}{i_g}\cdot(\varphi_{Cnk,2} - \varphi_{Cnk,1}) \tag{4}$$

If an error in the sensor signal is identified between the two camshaft interrupts, then with this equation the correct rotor angle $\phi_{Em,2}$ can be calculated and used for the coarse correction of the positional measurement value.

The achievable accuracy shall be presented for one example:

The EC motor 14 shall have m=3 magnetic field sensors and p=7 pole pairs. The stationary transmission gear ratio of the adjustment mechanism for a stationary crankshaft 12 shall be $$i_g=n_{Em}/n_{Cam}=-62,$$

where $n_{Em}$ designates the rotational speed of the EC motor and $n_{Cam}$ designates the rotational speed of the camshaft 11. The following inaccuracies, which are specified as superscripts and subscripts at the individual angles in degrees, would be present:

$$\varphi_{Em,2}{}^{+16.2}_{-7.7} = \varphi_{Em,1}{}^{+8.57}_{-0} + 31.5\cdot\left(\varphi_{Cnk,2}{}^{+0.25}_{-0} - \varphi_{Cnk,1}{}^{+0.25}_{-0}\right)$$

The uncertainty of the rotor angle of +16.2°/−7.7° corresponds to +2/−1 increments, that is, significantly fewer than 2·m=6 increments. A coarse correction with the help of this method is thus possible.

Through a fine extrapolation of the rotor angle for the first camshaft interrupt, the uncertainty can be halved from +8.57°/−0° to approximately +2°/−2°. For this purpose, estimated values are determined for the position with the rotor 17 at the time of the camshaft interrupt and the cyclical interrupt.

Figure 4:
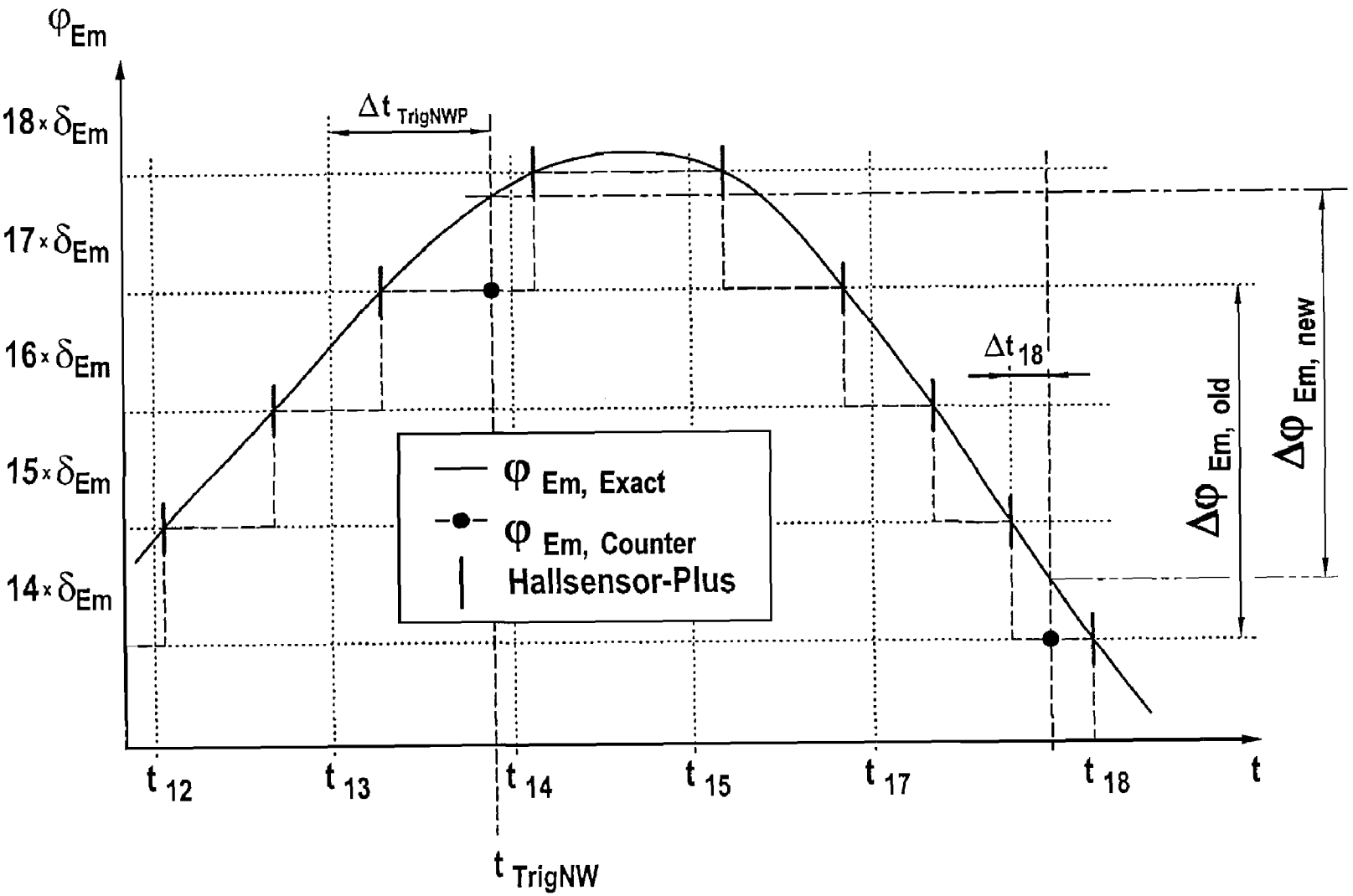
FIG. 4: a graphical representation of the actual rotational angle of the EC motor rotor, wherein the positions, at which magnetic field sensor pulses occur are marked in the rotational angle profile, and the time is recorded on the abscissa and the rotational angle is recorded on the ordinate.

Below the extrapolation is explained with reference to FIG. 4. At the time $t_{TrigNW}$ of the camshaft interrupt, the positional measurement value $N_{TrigNW}$ corresponding to the rotor rotational angle value for the measurement device, the time $\Delta t_{TrigNW}$, and also the rotational speed $\omega_{Em,TrigNW}$ (signed) at the last change of the magnetic segment combination are available. Corresponding data can be accessed at each cyclical interrupt. For example, at the time $t_{16}$ of the counter state $N_{115}$, the time difference $\Delta t_{16}$ and the rotational speed $\omega_{Em,115}$ are available.

With this data, the angle covered since the occurrence of the last change of the magnetic-sensor combination and thus the position of the EC motor at the camshaft trigger and at the current control device interrupt $t_1$ can be determined as follows:

$$\phi_{Em,TrigNW}=N_{TrigNW}\cdot\delta_{Em}+\Delta t_{TrigNW}\cdot\omega_{Em,TrigNW}$$

$$\phi_{Em,ti}N_{ti}*\delta_{Em}+\Delta t_i\cdot\Delta_{Em,ti}$$

The resolution $\delta_{Em}$ of the measurement device 17 results from the number of pole pairs p and the number m of magnetic field sensors A, B, C:

$$\delta_{Em} = \frac{360°}{2 \cdot m \cdot P} = \frac{360°}{2 \cdot 3 \cdot 7} = 8.57°.$$

In the method for positional determination for the EC motor 14 for the device for adjusting the rotational angular position of the camshaft 11 of the reciprocating piston combustion engine relative to the crankshaft 12, for each occurrence of a state change of a sensor signal, a positional measurement signal is tracked by magnetic field sensors A, B, C, which are arranged on the stator of the EC motor 14 and which are provided for detecting the magnetic poles of the EC rotor 17. For error-free measurement, the sensor signal cycles through a sequence of sensor signal states, wherein this sequence occurs at least twice for each mechanical rotation of the rotor 17. The sequence of sensor signal states is determined and stored. With the help of the stored sequence, a fine correction of the position measurement signal is performed, if the sequence of the measured sensor signal values deviates from the stored sequence. In addition, the rotational angle of the crankshaft 12 of the combustion engine is determined and coarse correction of the positional measurement signal is performed with the help of the rotational angle and a gear parameter of a planetary gear system of the camshaft adjustment device for determining a positional measurement error, which cannot be corrected with the fine correction.

LIST OF REFERENCE SYMBOLS

1 . . . 8 Magnetic field sensor
11 Camshaft
12 Crankshaft
13 Adjustment mechanism
14 EC motor
15 Sensor
16 Toothed ring
17 Rotor
18 Hall sensor
19 Trigger wheel
A Magnetic field sensor
B Magnetic field sensor
C Magnetic field sensor

The invention claimed is:

1. Method for positional determination for an EC motor for a device for adjusting a rotational angular position of a camshaft of a reciprocating piston combustion engine relative to a crankshaft, wherein the crankshaft is in driving connection with the camshaft via an adjustment mechanism, which comprises a triple-shaft transmission with a crankshaft-fixed drive shaft, a camshaft-fixed driven shaft, and an adjustment shaft, which is in driving connection with the EC motor, wherein a rotor of the EC motor has magnetic segments, which are offset relative to each other in a peripheral direction and which are magnetized alternately in opposite directions, wherein for determining a position of the rotor relative to a stator of the EC motor, a measurement device is provided, which has magnetic field sensors, which are offset relative to each other in the peripheral direction and which are arranged such that they generate, in an error-free measurement for a rotational movement of the rotor in a direction of an arrow relative to the stator, a digital sensor signal, which cycles through a sequence of sensor signal states, wherein the sequence occurs at least two times for each mechanical rotation of the rotor, the method comprising:

a) determining and storing the sequence of sensor signal states, b) setting a positional measurement signal to a start value, c) wherein the rotor rotates relative to the stator and for each occurrence of a state change of the sensor signal, tracking the positional measurement signal, d) wherein for a first positional measurement value of the positional measurement signal, detecting a first rotational angle measurement value and for a second positional measurement value, a second rotational angle measurement value of the crankshaft, e) using the first positional measurement value, the first and second rotational angle measurement value, and also a transmission parameter of the adjustment mechanism for determining a control value for the second positional measurement value, f) calculating a difference between the control value and the second positional measurement value is formed and for a case in which the difference exceeds a given threshold in magnitude, performing a coarse correction of the positional measurement signal by adding a coarse correction value corresponding to the difference to the second positional measurement value and using the result as a new second positional measurement value, g) wherein, with reference to a first sensor signal value assigned to the first positional measurement value and the stored sequence of sensor signal states, carrying out a test value for a second sensor signal value assigned to the second positional measurement value, h) comparing the test value with the second sensor signal value and for the case that a deviation is determined, performing a fine correction of the positional measurement signal by adding a fine correction value, which corresponds to a spacing that the test value has in the sequence of sensor signal states to the second sensor signal value, is added to the second positional measurement value and using the result as a new second positional measurement value, i) and repeating the steps c) to h) if necessary.

2. Method according to claim 1, wherein for the first and second crankshaft rotational angle, a crankshaft rotational angle measurement time is detected, an estimated value for the rotational angle that the crankshaft exhibits at a reference time is extrapolated from the first and second crankshaft rotational angles, a time difference between the crankshaft rotational angle measurement times, and also a time interval between the crankshaft rotational angle measurement time of the second crankshaft rotational angle and the reference time, and the coarse correction and/or the fine correction is performed with the estimated value as the new second rotational angle measurement value.

3. Method according to claim 1, wherein for the first and second positional measurement values, a positional measurement value measurement time is detected, an estimated value for the value that the positional measurement signal exhibits at the reference time is extrapolated from the first and second positional measurement values, a time difference between the positional measurement value measurement times, and also a time interval between the positional measurement value measurement time of the second positional measurement value and the reference time, and the coarse correction is performed with the estimated value as the new second positional measurement value.

4. Method according to claim 1, wherein the reference time is generated at a given rotational angular position of the camshaft.

5. Method according to claim 1, wherein the positional measurement values are differentiated for forming angular velocity values.

6. Method according to claim 1, wherein a correction value is determined and stored for compensation of tolerances of the magnetic segments and/or the magnetic field sensors for individual ones of the magnetic segment-sensor combinations, and the positional measurement values and/or angular velocities are corrected with the correction values.

* * * * *